US005419158A

United States Patent [19]

Sandberg et al.

[11] Patent Number: 5,419,158

[45] Date of Patent: May 30, 1995

[54] WRAP RING ASSEMBLY

[75] Inventors: Sam Sandberg, New York, N.Y.; Robert Hurwitz, Ridgewood, N.J.; Kla Paturmarj, New York, N.Y.

[73] Assignee: Sandberg & Sikorski Diamond Corporation, New York, N.Y.

[21] Appl. No.: 196,952

[22] Filed: Feb. 15, 1994

Related U.S. Application Data

[63] Continuation-in-part of Ser. No. 177,739, Jan. 4, 1994, abandoned.

[51] Int. Cl.[6] ..... A44C 9/00

[52] U.S. Cl. ..... 63/15.4; 63/15.1; 63/15.3

[58] Field of Search ..... 63/15.1, 15.2, 15.3, 63/15.4, 15.7, 15

[56] References Cited

U.S. PATENT DOCUMENTS 858,450 7/1907 Greenbaum ..... 63/15.2

5,253,490 10/1993 Doganay ..... 63/15.4

FOREIGN PATENT DOCUMENTS 577308 9/1924 France ..... 63/15.7

*Primary Examiner*—Michael J. Milano

*Attorney, Agent, or Firm*—Gottlieb, Rackman & Reisman

[57] ABSTRACT

A wrap ring assembly comprising a pair of wrap rings for accommodating an engagement or other ring therebetween is provided. The wrap ring assembly includes a first ring having a first band and a second ring having a second band spaced from and substantially parallel to the first ring. The rings of the assembly are interconnected by a pivot assembly which enables the bands to revolve about a common axis that is tangent to the periphery of each of the bands.

30 Claims, 5 Drawing Sheets

FIG. 1
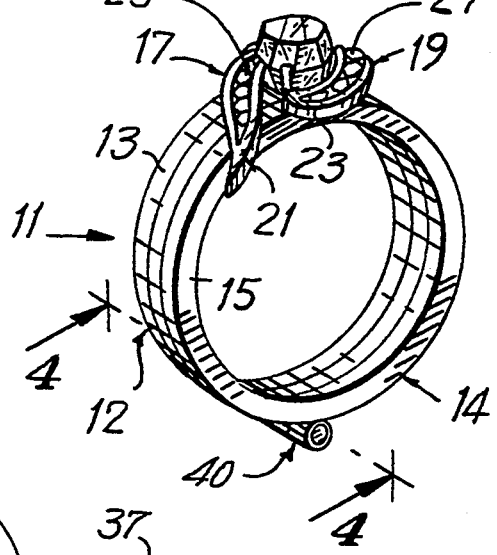
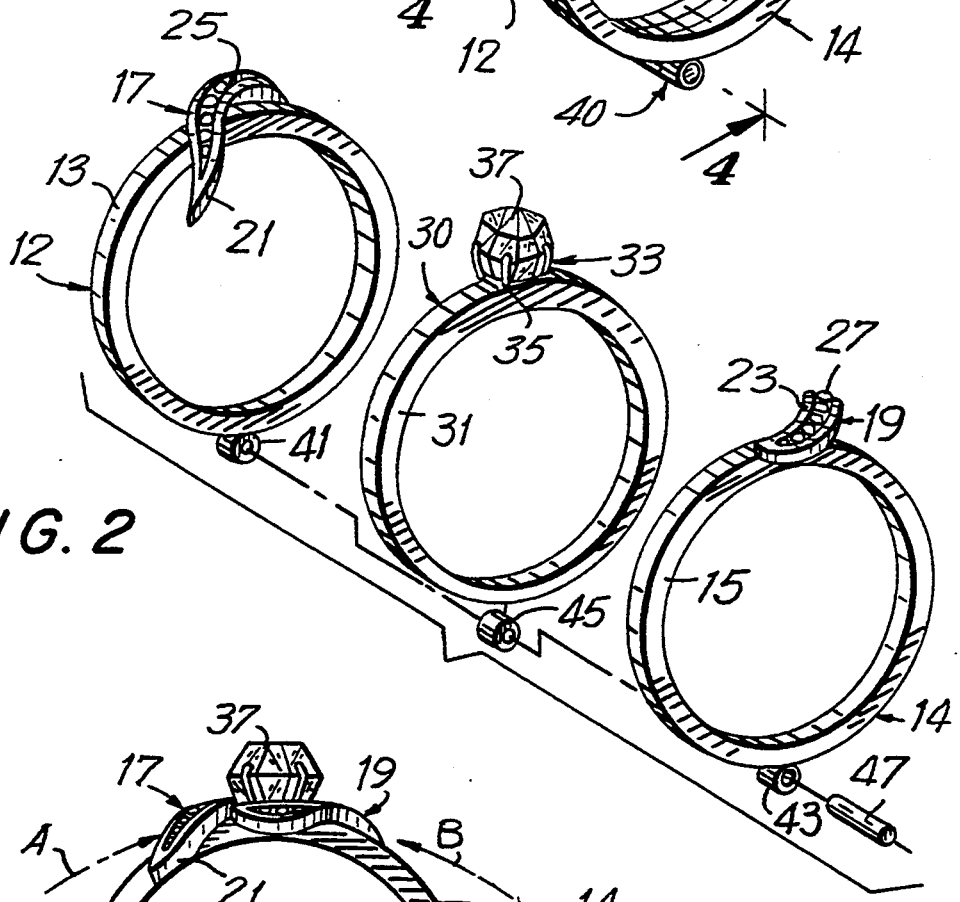
FIG. 2
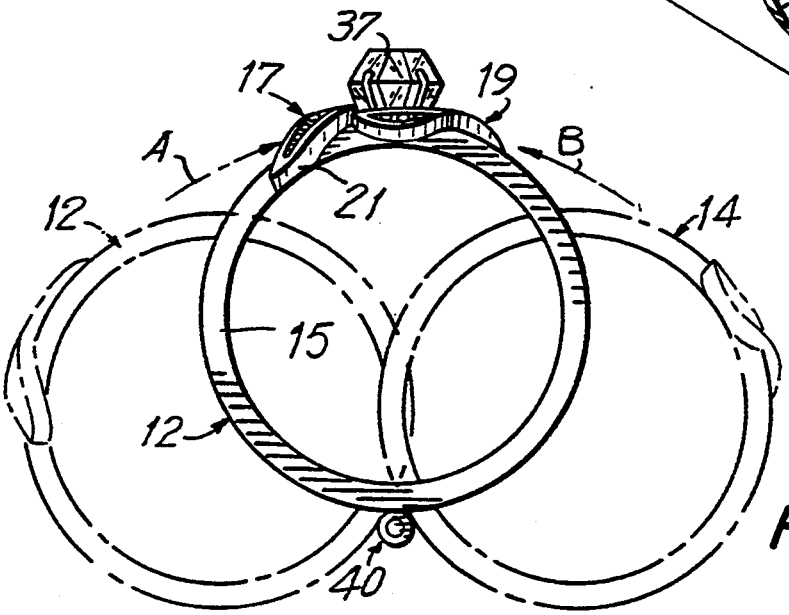
FIG. 3

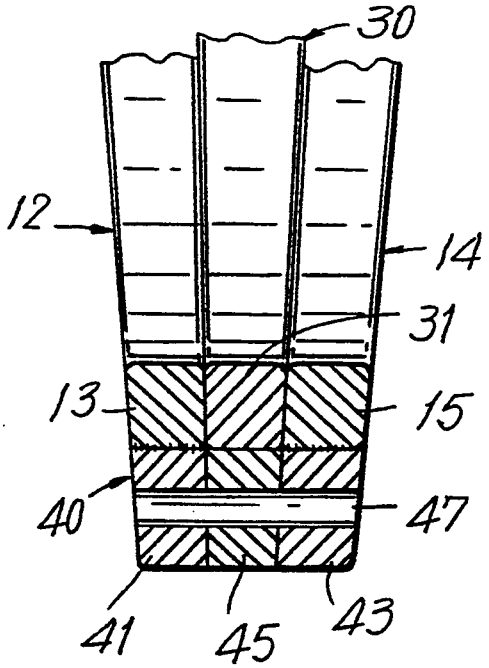
FIG. 4
FIG. 5
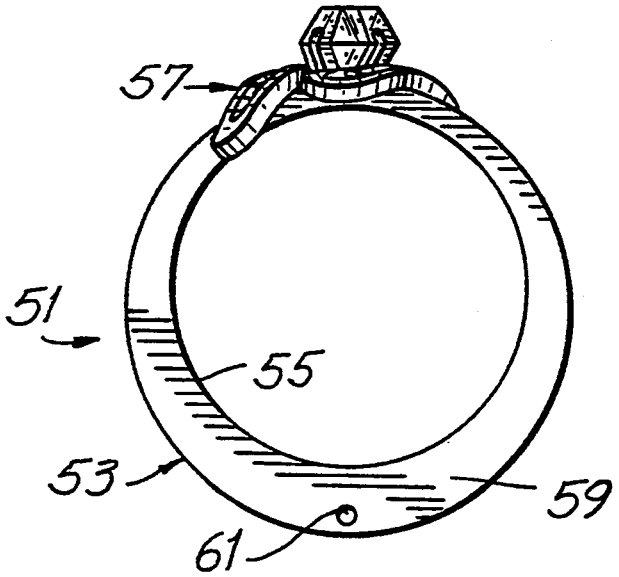

FIG. 6
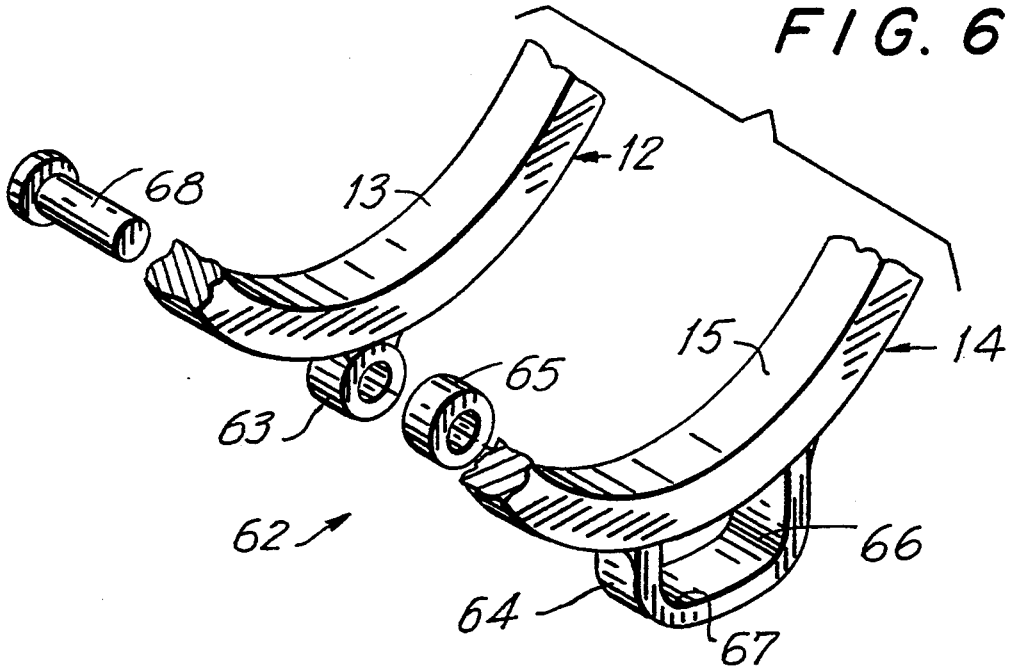
FIG. 7
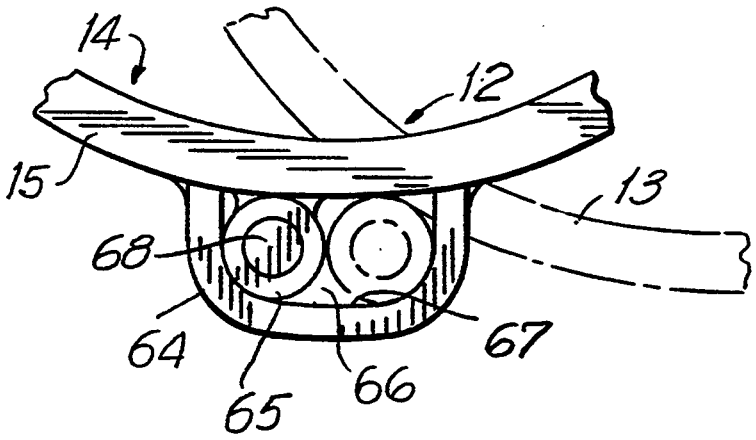
FIG. 8(a)
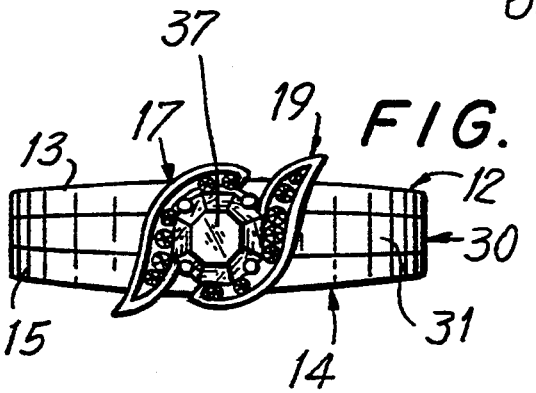
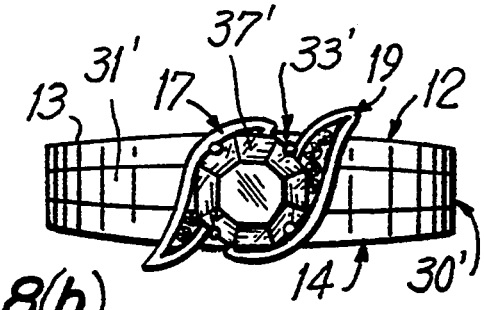
FIG. 8(b)

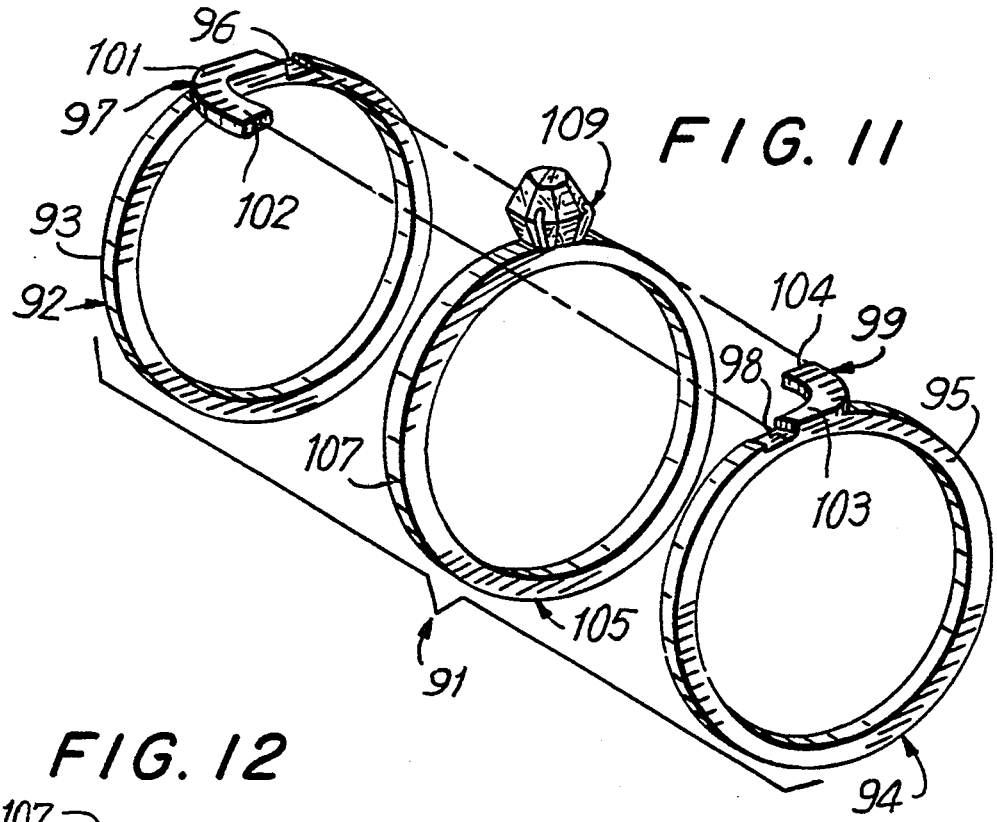
FIG. 11
FIG. 12
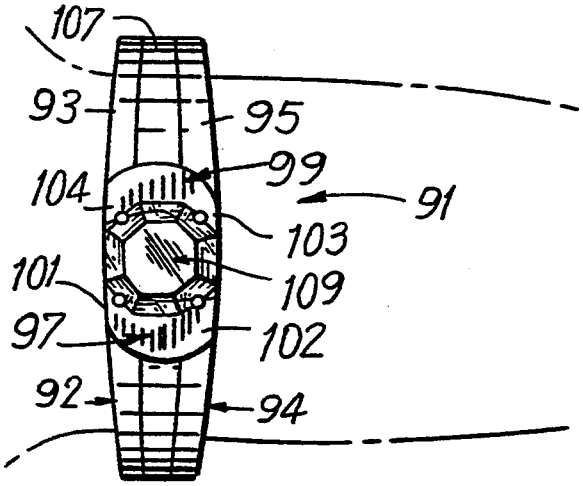
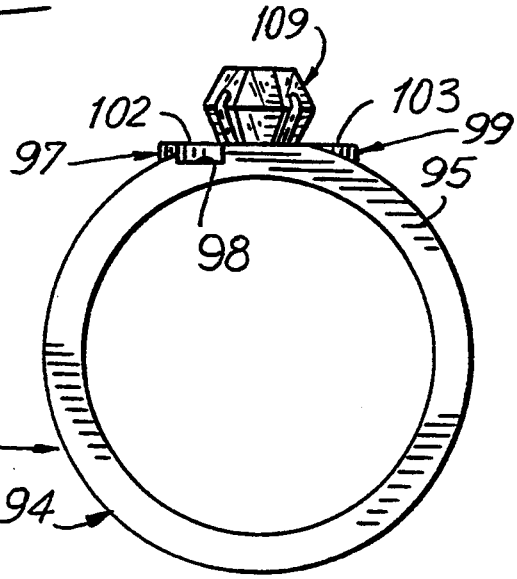
FIG. 13

WRAP RING ASSEMBLY

This is a continuation-in-part application of Ser. No. 08/177,739, filed Jan. 4, 1994, now abandoned.

BACKGROUND OF THE INVENTION

This invention relates to a wrap ring assembly, and more particularly, to a wrap ring assembly which maintains an engagement or other ring in a captured or wrapped condition on the finger of the wearer.

Wrap rings are one of the best selling rings in the jewelry trade. Wrap rings are very popular because of their versatility when paired with a diamond solitaire. A single wrap ring may be used as a wedding or anniversary band, with re-mounts and engagement ring settings. A wrap ring is particularly desirable because it offers the flexibility of new setting without changing the original ring.

Although a single wrap ring is still very popular, a few jewelers have recently manufactured and sold as a set a pair of wrap rings which are constructed to receive a diamond solitaire therebetween. Specifically, the bands of the wrap rings include a complimentary pair of mountings which define an opening therebetween through which the diamond of the ring projects. The mounting may include one or more gem elements which can mirror each other in appearance.

Although the use of a pair of wrap rings with a diamond solitaire or some other ring disposed therebetween has significant aesthetic advantages, and can create a different and perhaps more desirable look, the overall assembly is less than desirable. When worn on the finger of the wearer, the two wrap rings and the wrapped diamond engagement ring will have the tendency to slide and/or separate. This is especially true if the rings themselves are slightly too loose or the temperature is significantly reduced, contracting the wearer's finger in size.

Accordingly, it would be desirable to overcome the above disadvantages, and construct a wrap ring assembly which maintains the wrapped diamond solitaire in a captured condition with the two wrap rings.

SUMMARY OF THE INVENTION

Generally speaking, in accordance with the invention, a wrap ring assembly comprising a pair of wrap rings for accommodating an engagement or other ring therebetween is provided. The wrap ring assembly includes a first ring having a first band and a second ring having a second band spaced from and substantially parallel to the first ring. The rings of the assembly are interconnected by means of a pivot assembly which enables the bands to revolve about a common axis that is tangent to the periphery of each of the bands.

The bands of the assembly are selectively moveable from a first unaligned condition, which enables insertion of an engagement ring between the rings, to a second aligned condition, such that the assembly can be worn on the finger of a wearer. In particular, the rings of the assembly define a space therebetween for accommodating the engagement ring, which is placed in alignment with the two rings so that the entire assembly may be worn.

Preferably, each of the rings of the assembly comprises a wrap ring having a similar mounting fixed therealong. Each mounting comprises a setting having a specific ornamental configuration containing one or more stones, gems or other type of ornament. When the two rings of the assembly are aligned, the respective mountings define an opening therebetween through which the stone of the wrapped engagement ring projects.

The pivot assembly which is used for interconnecting the two rings of the assembly comprises a bearing for each ring and a rotatable pin that is fitted within the two bearings and which enables the two rings to selectively revolve about a common axis. Alternatively, the pivot assembly comprises a bearing for each ring that extends transversely from each ring and a rotatable pin parallel to the rings and extending transversely through the bearings to enable the rings to selectively pivotally rotate about the first pin.

In a further embodiment, the wrap ring assembly of the invention comprises a first ring or band and a second ring or band, and means for selectively interconnecting the rings or bands when aligned comprising at least one arm extending transversely from one of the rings or bands and a notch formed in the other of the bands for releasibly mating with the extending arm.

The assembly of the invention is particularly advantageous since the two rings cannot separate when worn on the finger of the wearer. The engagement ring located between the two rings of the assembly is always maintained in proper position, ensuring the aesthetic appeal of the overall assembly.

In addition, since the ring assembly of the invention and the wrapped engagement ring are joined together when worn, there is much less of a risk that one or more of the rings will slide off the user's finger.

Accordingly, it is an object of the invention to provide an improved wrap ring assembly.

Another object of the invention is to provide a wrap ring assembly that comprises a pair of revolvable interconnecting bands.

Still a further object of the invention is to provide a wrap ring assembly which maintains an engagement or other ring in a captured or wrapped condition.

Yet another object of the invention is to provide a ring assembly having a pair of mountings that define a space or opening through which a stone of another ring can selectively project.

Still other objects and advantages of the invention will in part be obvious and will in part be apparent from the following description.

The invention accordingly comprises the assembly possessing the features, properties and relation of components which will be exemplified in the assembly hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 1 is a perspective view of the wrap ring assembly of the invention in a closed condition, with an engagement ring disposed between the two bands of the ring assembly;

FIG. 2 is an exploded perspective view of each of the rings or bands of the wrap ring assembly and the engagement ring that is adapted to be disposed between the two bands;

FIG. 3 is a front elevational view of the wrap ring assembly of the invention and showing the assembly in an open condition so that an engagement ring may be inserted between the two bands of the assembly;

FIG. 4 is a cross-sectional view taken along line 4—4 of FIG. 1 and illustrates in detail the pivot assembly for revolvably interconnecting the bands of the wrap ring assembly;

FIG. 5 is a front elevational view of an alternative embodiment of the wrap ring assembly of the invention;

FIG. 6 is an exploded perspective view of a further embodiment of the wrap ring assembly;

FIG. 7 is a side elevational view of the wrap ring assembly illustrated in FIG. 6;

FIG. 8(*a*) is a top plan view of the wrap ring assembly illustrated in FIGS. 6 and 7, in which an engagement ring having a first sized stone is disposed between the two bands of the assembly;

FIG. 8(*b*) is a top plan view of the wrap ring assembly illustrated in FIGS. 6 and 7, with an engagement ring having a second sized stone disposed between the two bands of the assembly;

FIG. 11 is an exploded perspective view of each of the rings or bands of a fifth embodiment of the wrap ring assembly of the invention and an engagement ring that is adapted to be disposed between the two bands;

FIG. 12 is a top plan view of the wrap ring assembly illustrated in FIG. 11 with the engagement ring disposed between the two bands; and FIG. 13 is a side elevational view of the assembly depicted in FIG. 12.

DETAILED DESCRIPTION OF THE PREFERRED EMBODIMENTS

Figure 9:
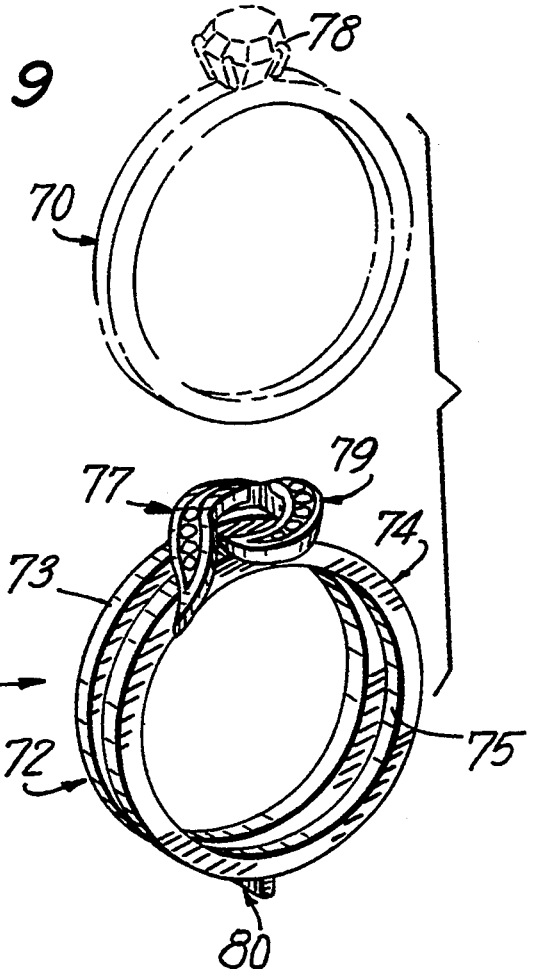
FIG. 9 is an exploded perspective view of a fourth embodiment of the wrap ring assembly of the invention.

Referring first to FIGS. 1 and 2, a wrap ring assembly made in accordance with the invention and generally indicated at 11 is described. Ring assembly 11 comprises a first ring 12 and a second ring 14 spaced in substantially parallel relationship to first ring 12. Ring 12 includes a band 13 and a mounting 17 fixed thereon, as is well known in the art. Similarly, second ring 14 includes a band 15 and a mounting 19. Bands 12 and 14 may be made of gold, silver, platinum or some other type of metal.

Each of mountings 17 and 19 comprises a setting 23 and 25 respectively having a similar arcuate configuration and a series of stones 25 and 27 mounted in settings 23 and 25 respectively for providing a specific aesthetic appearance. Stones 25 and 27 may be selected from diamonds, rubies, sapphires, emeralds, and other precious, semi-precious or created stones, as is well known in the art. Significantly, as described in greater detail below, each of mountings 17 and 19 define a space therebetween, as best shown in FIG. 1, for receiving the stone of a ring received in assembly 11.

Bands 13 and 15 of rings 12 and 14 are revolvably interconnected by means of a pivot assembly, generally indicated at 40, as best shown in FIGS. 1 and 4. Pivot assembly 40 comprises a bearing 41 fixed to and projecting from the periphery of band 13 and a bearing 43 fixed to and projecting from the periphery of band 15. Pivot assembly 40 also includes a spacer 45 disposed between bearings 41 and 40. Bearing 41, bearing 43 and spacer 45 define an aligned pathway therethrough for receiving a pivot pin 47 (see FIG. 4). Pivot pin 47 is irrotatably mounted in one of bearings 41 and 43 and rotatably mounted in the other of bearings 41 and 43 to enable bands 13 and 15 to swivel about each other, as shown in FIG. 3. Preferably, at least one end of pivot pin 47 is formed with a head to prevent pin 47 from sliding out of bearings 41 and 43.

In use, a ring 30, such as an engagement ring, is mounted between rings 12 and 14 of assembly 11, as shown in FIGS. 1 and 3. Ring 30 comprises a band 31 and a mounting 33 fixed thereon. Mounting 33 includes a multi-prong setting 35, as is well known in the art, for retaining a stone 37, such as a solitaire or some other type of diamond.

Initially, ring 30 is inserted between rings 12 and 13, as shown in FIG. 3, such that the location along band 31 opposite stone 33 abuts against pivot assembly 40. Then, rings 12 and 14 are rotated in the direction of arrows A and B in order to close assembly 11 and capture stone 37 between mountings 17 and 19, as shown in FIG. 1.

Once ring 30 has been wrapped between rings 12 and 14 of assembly 11, the entire assembly can be put on the finger of the wearer. Because ring 30 is captured between rings 12 and 14, the bands of each of the rings are prevented from sliding and/or separating along the wearer's finger.

In an alternative embodiment, as shown in FIGS. 6–8(*a* and *b*), bands 13 and 15 of rings 12 and 14 are revolvably interconnected by means of a pivot assembly 62. Pivot assembly 62 comprises a bearing 63 fixed to and projecting transversely from the periphery of band 13, a U-member 64 extending downwardly from band 15 and a second bearing 65 aligned with bearing 63 and slidably received in U-member or bracket 64.

U-member 64, which depends from band 15 of ring 14, is formed with a passage or slot 66 defining a track 67 along which bearing 65 can selectively slide in a transverse direction, as shown in FIG. 7.

Each of bearings 63 and 65 is formed with aligned openings therethrough for accommodating a pivot pin 68. Pivot pin 68 is irrotatably mounted in one of bearings 63 and 65 and rotatably mounted in the other to enable bands 13 and 15 to swivel about each other. Moreover, because bearing 65 can selectively slide along track 67 of U-member 64, as shown in FIG. 7, bands 13 and 15 can laterally move relative to each other.

In use, engagement ring 30 is mounted between rings 12 and 14 of the assembly, as shown in FIG. 8(*a*). This is accomplished in the same manner as in the main embodiment of FIGS. 1–4, as discussed above. However, with respect to this embodiment, engagement rings having solitaires of various sizes may be used.

Referring now to FIG. 8(*b*), a second engagement ring 30' is mounted between rings 12 and 14 of the assembly. Ring 30' comprises a band 31' and a mounting 33' fixed thereon. Mounting 33' includes a multi-prong setting for retaining a stone 37', such as a solitaire or some other type of gem. Stone 37' is somewhat larger in size than stone 37 depicted in FIG. 8(*a*).

In operation, ring 30' is inserted between rings 12 and 13. As with the first embodiment depicted in FIGS. 1–4, rings 12 and 14 are rotated in order to close the assembly and capture stone 37' between mountings 17 and 19.

In order to wear the assembly on ones finger, bands 13 and 15 of rings 12 and 14 must be substantially aligned. However, in order to achieve alignment while at the same time revolvably rotating rings 12 and 14 in order to close the assembly, the space formed between mountings 17 and 19 may be too small (or in other cases too large) for capturing stone 37' therebetween. In accordance with the invention, therefore, the space between mountings 17 and 19 may be selectively adjusted in size by sliding bearing 65 of pivot assembly 62 along track 67 of U-member 64, as discussed above. As shown in FIGS. 7 and 8(*b*), bearing 65 is slid or moved in order to adjust the relative positions of bands 13 and 15 and thereby enlarge the space between mountings 17 and 19. This enlarged space is now suitable for accommodating stone 37' of engagement ring 35.

Referring now to FIG. 5, another embodiment of the inventive ring assembly is now described. As shown, ring assembly 51 includes a ring 53 and a second ring (not shown) spaced in substantially parallel relationship to ring 53. Ring 53 comprises a band 55 having an annular surface 59 and a mounting 57, as described above. Ring 53 is interconnected to the second ring by means of a bearing 61, which rotatably receives a pivot pin (not shown), as described with respect to the first embodiment.

Significantly, bearing 61 is fixed to and projects from annular surface 57 of band 55, rather than extending from the periphery of band 55, as in the embodiment of FIGS. 1–4. Accordingly, ring assembly 51 can only accommodate a ring therewithin having a band of narrow thickness, since the opening of the band must be the same size as the openings of the bands of assembly 51. If band thickness were too great, the nested ring could not fit over bearing 61.

Although the pivot assembly used in the invention is fixed in perpendicular relationship with the two rings so that the bands are revolvably rotatably interconnected along a pair of parallel planes, the pivot assembly could be fixed in parallel relationship to the two rings so that the bands are rotatably interconnected so that they can move transversely with respect to the planes of the bands.

Figure 10:
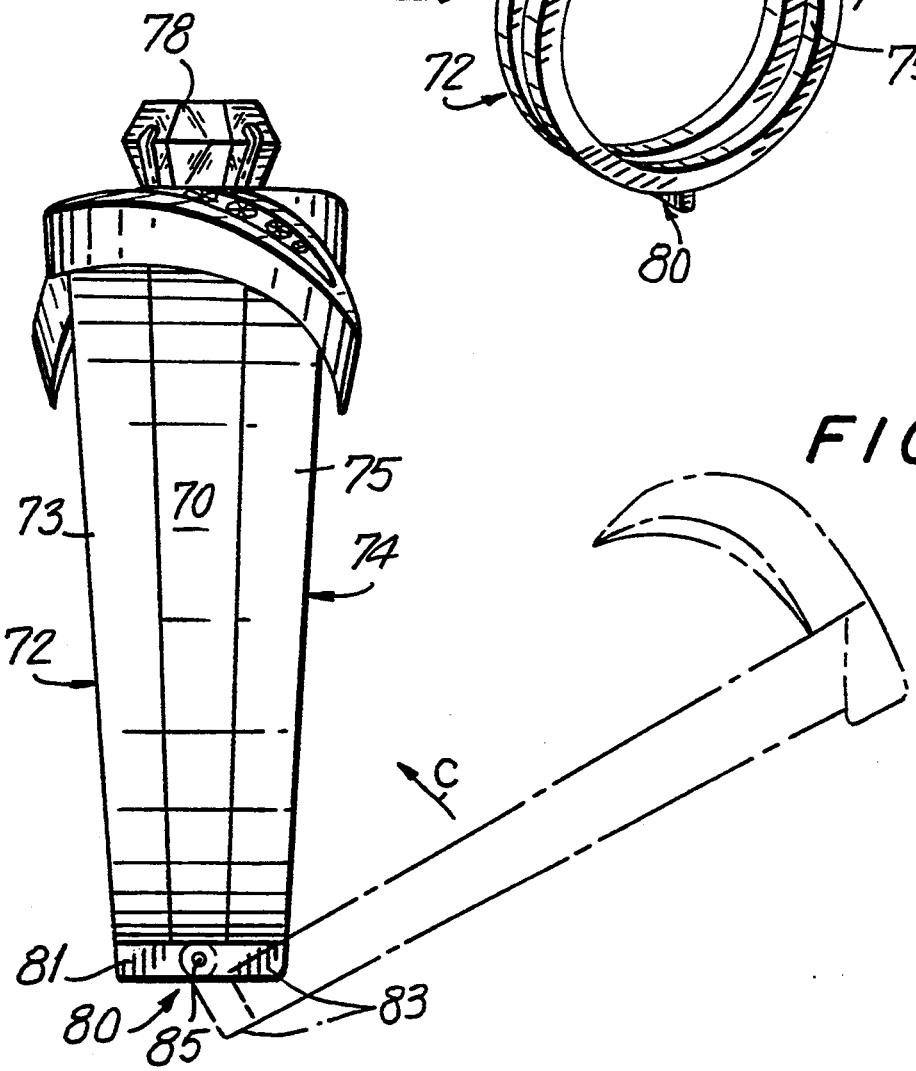
FIG. 10 is a side elevational view of the wrap ring assembly illustrated in FIG. 9 with an engagement ring disposed between the two bands of the assembly.

As shown in FIGS. 9 and 10, a fourth embodiment of a wrap ring assembly made in accordance with the invention is generally indicated at 71. Assembly 71 comprises a first ring 72 and a second ring 74 spaced in substantially parallel relationship to first ring 72. Ring 72 includes a band 73 and a mounting 77 fixed thereon, while ring 74 includes a band 75 and a mounting 79. Construction of rings 72 and 74 is substantially similar to the construction of rings 12 and 14 of assembly 11 as depicted in FIGS. 1–5.

Bands 73 and 75 of rings 72 and 74 are rotatably interconnected by means of a pivot assembly, generally indicated at 80. Pivot assembly 80 comprises a bearing 81 fixed to and extending transversely in a first direction from the periphery of band 73, and a bearing 83 fixed to and extending transversely in a second opposite direction from the periphery of band 75. Each of bearings 81 and 83 is formed with a transverse opening therethrough in the portion extending away from bands 73 and 75. These openings are aligned in order to receive a pivot pin 85 (see FIG. 10). Pivot pin 85 is disposed in parallel relation to bands 73 and 75 and is rotatably mounted in at least one of the aligned openings formed in bearings 81 and 83. This enables bearings 81 and 83 to pivotally rotate, as shown in FIG. 10.

In use, a ring 70, such as an engagement ring, is mounted between rings 72 and 74, in a manner similar to what is described with respect to the embodiment of FIGS. 1–4. Rings 72 and 74 are pivotally rotated in the direction of arrow C in order to close assembly 71 and capture stone 78 between mountings 77 and 79. Once ring 70 has been wrapped between rings 72 and 74 of assembly 71, the entire assembly can be placed on the finger of the wearer.

In a fifth embodiment of the inventive ring assembly, as shown in FIGS. 11–13, ring assembly 91 comprises a first ring 92 and a second ring 94. Ring 92 includes a band 93 and a arcuate-shaped mounting 97; ring 94 includes a band 95 and similarly shaped arcuate mounting 99. Each of bands 93 and 95 are formed with a cutout or notch 96 and 98 respectively on the outside surfaces thereof and adjacent mountings 97 and 99.

Each of mountings 97 and 99 comprise a base portion 101, 103 and a projecting arm 102, 104. Arms 102 and 104 are sized for mating reception with notches 98 and 96 respectively of bands 95 and 93.

In use, ring 105, such as an engagement ring, is designed to fit between rings 92 and 94, as shown in FIG. 12. Ring 105 comprises a band 107 and a stone 109, as is well known in the art. Prior to placing the overall assembly on the finger of the wearer, ring 105 is seated between rings 92 and 94 such that all three rings are aligned and mountings 97 and 99 capture stone 109 of ring 105 therebetween.

Because of the configuration of mountings 97 and 99 and notches 96 and 98, arm 102 of mounting 97 engages and is seated within notch 98 of band 95, while arm 104 of mounting 99 engages and is seated within notch 96 of band 93. This coupling arrangement of rings 92, 94 and 105, as best depicted in FIG. 12, prevents one or more of the rings from separating, either during wear on the finger or while the assembly is being stored.

It will thus be seen that the objects set forth above, among those made apparent in the preceding description, are efficiently attained, and since certain changes may be made in the described assembly and its construction without departing from the spirit and scope of the invention, it is intended that all matter contained in the above description and shown in the drawings, shall be interpreted as illustrative and not in a limiting sense.

It is also to be understood that the following claims are intended to cover all of the generic and specific features of invention herein described and all statements of the scope of the invention which, as a matter of language, may be said to fall there between.

We claim:

1. A ring assembly comprising:

a first ring including a first band;

a second ring including a second band disposed in substantially parallel relationship to said first ring;

pivot means located along said bands for revolvably interconnecting said bands in order to enable rotational movement thereof substantially about a common axis such that said bands are selectively moveable from a first unaligned condition to a second substantially aligned condition;

means for spacing said first and second bands for selectively accommodating a third removable ring including a third band;

wherein said bands define a pair of substantially parallel planes and are enabled to selectively angularly move therealong when rotated about said axis.

2. The assembly of claim 1, wherein said first ring includes a first mounting located along said band at a first location and said second ring includes a second mounting located along said band at a second location.

3. The assembly of claim 2, wherein said bands are interconnected by said pivot member at locations therealong substantially opposite to said first and second locations along said respective bands.

4. The assembly of claim 2, wherein said first and second mountings are substantially juxtaposed in position when said bands are in said aligned condition.

5. The assembly of claim 4, wherein said mountings of said first and second rings define an opening therebetween when the bands are in said aligned condition for selectively accommodating a mounting projecting from said band of said third ring.

6. The assembly of claim 2, wherein each of said mountings of said first and second rings comprises a setting and at least one stone retained in said setting.

7. The assembly of claim 1, wherein said pivot member comprises a first bearing fixed to said first band and a second bearing fixed to said second band and rotatable with respect to said first bearing.

8. The assembly of claim 7, wherein said bearings are formed with aligned openings therethrough for receiving a pivot pin.

9. The assembly of claim 4, where said first and second mountings have substantially the same configurations.

10. The assembly of claim 9, wherein said mountings are disposed in mirrored relationship with each other when said bands are in said aligned condition.

11. The assembly of claim 1, wherein said pivot member includes means for adjusting the relative position of said axis with respect to at least one of said bands.

12. The assembly of claim 11, wherein said adjusting means comprises a bearing and means for slidably receiving said bearing along at least one of said bands.

13. The assembly of claim 12, wherein said receiving means comprises a guide bracket depending from said at least one band.

14. A ring assembly comprising:

a first ring including a first band;

a second ring including a second band disposed in spaced substantially parallel relationship to said first ring;

pivot means located along said bands for revolvably interconnecting said first and second bands in order to enable rotational movement thereof substantially about a common axis such that said bands are selectively moveable from a first unaligned condition to a second substantially aligned condition; and a third ring including a third band removably disposed between and substantially parallel to said first and second interconnected bands, said third ring being not interconnected to the pivot means when disposed between said first and second interconnected bands;

wherein said bands define a pair of substantially parallel planes and are enabled to selectively angularly move therealong when rotated about said axis.

15. The assembly of claim 14, wherein said first ring includes a first mounting located along said band at a first location and said second ring includes a second mounting located along said band at a second location.

16. The assembly of claim 15, wherein said first and second bands are interconnected by said pivot member at locations there- along substantially opposite to said first and second locations along said respective bands.

17. The assembly of claim 15, wherein said first and second mountings are substantially juxtaposed in position.

18. The assembly of claim 17, wherein said mountings of said first and second rings define an opening therebetween for selectively accommodating a mounting projecting from the band of the third ring.

19. The assembly of claim 15, wherein each of the mountings of the first and second rings comprises a setting and at least one stone retained in the setting.

20. The assembly of claim 14, wherein the pivot member comprises a first bearing fixed to said first band and a second bearing fixed to said second band and rotatable with respect to the first bearing.

21. The assembly of claim 14, wherein said pivot member includes means for adjusting the relative position of said axis with respect to at least one of said first and second bands.

22. A wrap ring assembly comprising:

a first ring comprising a first band and a second ring comprising a second band;

engaging means for selectively interconnecting said rings when said bands are substantially aligned comprising an arm extending substantially transversely from each of said bands and a notch formed in each of said bands for releasibly mating with said extending arm of the other of said bands;

wherein said interconnected rings define a space therebetween for selectively accommodating a third ring including a third band;

wherein said arms define an opening therebetween when said rings are aligned for selectively accommodating a mounting projecting from said band of said third ring.

23. The assembly of claim 22, wherein said arms comprise mountings for said first and second rings.

24. A ring assembly comprising:

a first ring including a first band with a first inner circumference;

a second ring including a second band with a second inner circumference and disposed in spaced substantially parallel relationship to said first ring;

pivot means for revolvably interconnecting said bands in order to enable rotational movement thereof substantially about a common axis such that said bands are selectively moveable from a first unaligned condition to a second substantially aligned condition;

wherein said interconnected bands define a space therebetween when in said substantially aligned condition for selectively accommodating a third removable ring including a third band with a third inner circumference of substantially the same size as the first and second inner circumferences such that said circumferences of said first, second and third bands are enabled to be substantially aligned, said third ring being not interconnected to the pivot means when disposed between said first and second interconnected bands;

wherein said bands define a pair of substantially parallel planes and are enabled to selectively angularly move therealong when rotated about said axis.

25. The assembly of claim 24, wherein said first ring includes a first mounting located along said band at a first location and said second ring includes a second mounting located along said band at a second location.

26. The assembly of claim 25, wherein said mountings of said first and second rings define an opening therebetween for selectively accommodating a mounting projecting from said third ring when said third ring is accommodated in said space formed between said aligned first and second bands.

27. The assembly of claim 24, wherein said pivot means comprises a first bearing fixed to said first band and a second bearing fixed to said second band and rotatable with respect to said first bearing.

28. A ring assembly comprising:

a first ring including a first band;

a second ring including a second band disposed in spaced substantially parallel relationship to said first ring;

pivot means located along said bands for revolvably interconnecting said bands in order to enable rotational movement thereof substantially about a common axis such that said bands are selectively moveable from a first unaligned condition to a second substantially aligned condition;

wherein said interconnected bands define a space therebetween when in said substantially aligned condition for selectively accommodating a third removable ring including a third band;

wherein said bands of said first and second rings define a pair of substantially parallel planes and are enabled to selectively angularly move therealong when rotated about said axis;

wherein said pivot means includes means for adjusting the relative position of said axis with respect to at least one of said first and second bands.

29. The assembly of claim 28, wherein said adjusting means comprises a bearing and means for slidably receiving said bearing along at least one of said first and second bands.

30. The assembly of claim 29, wherein said receiving means comprises a guide bracket depending from said at least one of said first and second bands.

* * * * *